United States Patent [19]

Biswas

[11] 4,384,536

[45] May 24, 1983

[54] DESULFURIZATION AND IMPROVEMENT OF COMBUSTION AND GASIFICATION CHARACTERISTICS OF COALS

[75] Inventor: Bimal K. Biswas, Mountainside, N.J.

[73] Assignee: Foster Wheeler Energy Corporation, Livingston, N.J.

[21] Appl. No.: 249,566

[22] Filed: Mar. 31, 1981

[51] Int. Cl.[3] ..... F23B 7/00

[52] U.S. Cl. ..... 110/342; 44/1 SR; 110/218; 110/343

[58] Field of Search ..... 110/218, 229, 342, 343; 44/1 SR; 201/17

[56] References Cited

U.S. PATENT DOCUMENTS 3,909,211 9/1975 Diaz et al. ..... 44/1 SR
3,960,513 6/1976 Agarwal et al. ..... 44/1 SR
4,099,929 7/1978 Tippmer et al. ..... 44/1 SR
4,270,928 6/1981 Frischmuth ..... 44/1 SR

*Primary Examiner*—Edward G. Favors
*Attorney, Agent, or Firm*—Marvin A. Naigur; John E. Wilson; Warren B. Kice

[57] ABSTRACT

A process for the desulfurization of coal and apparatus for carrying out the process. The process includes the steps of: first, treating dry coal particles with dry chlorine gas; and, second, treating the coal particles with a purging gas. The purging gas may be, for example, dry steam or an inert gas, such as nitrogen or carbon dioxide. The apparatus includes a chlorinator means for treating the dry coal particles with dry chlorine gas and a stripper means for treating the coal particles with a purging gas.

20 Claims, 2 Drawing Figures

DESULFURIZATION AND IMPROVEMENT OF COMBUSTION AND GASIFICATION CHARACTERISTICS OF COALS

BACKGROUND OF THE INVENTION

1. Field of the Invention

The invention is in the field of desulfurizing and improving the combustion and gasification characteristics of coal. Sulfur in coal is a major source of pollutants from a coal-based energy system. The sulfur in coal appears in three main forms: pyritic, organic, and sulfate. In order for a coal-fired power plant to meet the various local and Federal emissions standards on sulfur dioxide ($SO_2$), a scrubber system presently must be installed. Such a system is massive and costly because it must handle a large volume of effluent gases in order to capture the minor component of pollutants. Thus, there is a major incentive to remove sulfur at the feed end of a coal-fired power plant.

2. Description of the Prior Art

The prior art includes the following patents:

U.S. Pat. No. 739,374 granted to Baker et al described a process of removing impurities, such as iron combined with sulfur, from gold and silver ores by contacting the ore with dry chlorine gas.

U.S. Pat. No. 1,426,054 granted to Estabrooke et al disclosed a process of desulfurizing coke by contacting the coke with chlorine gas in a blast furnace to produce volatile sulfur chloride.

U.S. Pat. No. 2,698,777 granted to Hartwick et al disclosed a process of removing metallic impurities from coal by contacting the coal with chlorine gas at an elevated temperature (1400° C. or higher). The metallic impurities were converted to volatile chlorides.

U.S. Pat. No. 3,926,575 granted to Meyers disclosed a process wherein finely divided coal containing pyrite was reacted with an aqueous solution of sulfur dioxide and hydrochloric acid (HCl).

U.S. Pat. No. 4,054,421 granted to Robinson et al disclosed a process for reducing the sulfur content of char by washing the char with hydrochloric acid followed by treatment with hydrogen gas.

U.S. Pat. No. 4,081,250 granted to Hsu et al described a method of desulfurizing coal at a moderate temperature and atmospheric pressure by the chlorinolysis of moist coal with the assistance of an organic solvent. In this method, chlorine gas was bubbled through a suspension of powered moist coal in methyl chloroform at a temperature of 74° C. and atmospheric pressure for 1 to 4 hours, followed by separation, hydrolysis and thermal dechlorination of the coal.

Finally, U.S. Pat. No. 4,118,200 granted to Kruesi disclosed a process for the desulfurization of inorganic and organic sulfur constituents of coal by treating the coal in a liquid fused salt bath in the presence of chlorine to react the sulfur-containing constituents with chlorine to form chlorides and elemental sulfur. The liquid fused salt bath was comprised of the chlorides of ferric iron, alkali metals, alkaline earth metals, ammonia, and zinc.

SUMMARY OF THE INVENTION

The invention is a process and apparatus for the desulfurization and improvement of combustion and gasification characteristics of dry coal particles containing sulfur in pyritic, organic, and sulfate forms.

The inventive process comprises the steps of:

(a) treating the dry coal particles with an effective amount of dry chlorine gas at a temperature and for a period of time which are sufficient for the chlorine gas to react with the sulfur in the coal particles whereby a significant quantity of pyritic sulfur is removed from the coal particles; and, (b) treating the coal particles with an effective amount of a purging gas at a temperature and for a period of time which are sufficient for the purging gas to remove a significant quantity of organic sulfur from the coal particles.

The inventive apparatus comprises:

(a) a means for providing dry chlorine gas;

(b) a chlorinator means for treating said dry coal particles with an excess amount of dry chlorine gas at a temperature and for a period of time which are sufficient for the chlorine gas to react with the sulfur in the coal particles whereby a significant quantity of pyritic sulfur is removed from said coal particles;

(c) a means for providing a purging gas; and, (d) a stripper means for treating said coal particles with a purging gas at a temperature and for a period of time which are sufficient for the purging gas to remove a significant quantity of organic sulfur from said coal particles.

The process and apparatus have the advantages of operating at relatively low temperatures and of removing significant amounts of pyritic sulfur, organic sulfur, and sulfate sulfur. It is highly unexpected that the process is capable of removing a significant amount of the organic sulfur found in coal. It is also unexpected that dry (super-heated) steam, when used as the purging gas, is capable of removing significantly more organic sulfur than other purging gases, such as nitrogen and carbon dioxide.

The treated coal is of a better quality for gasification and/or combustion as a result of losing much of the original sulfur and iron values. Furthermore, the inventive process produces a certain degree of porosity in the treated coal which thereby becomes more reactive than the original coal. Finally, no substantial calorific values of the coal are lost in the process.

DESCRIPTION OF THE PREFERRED EMBODIMENTS

Figure 1:
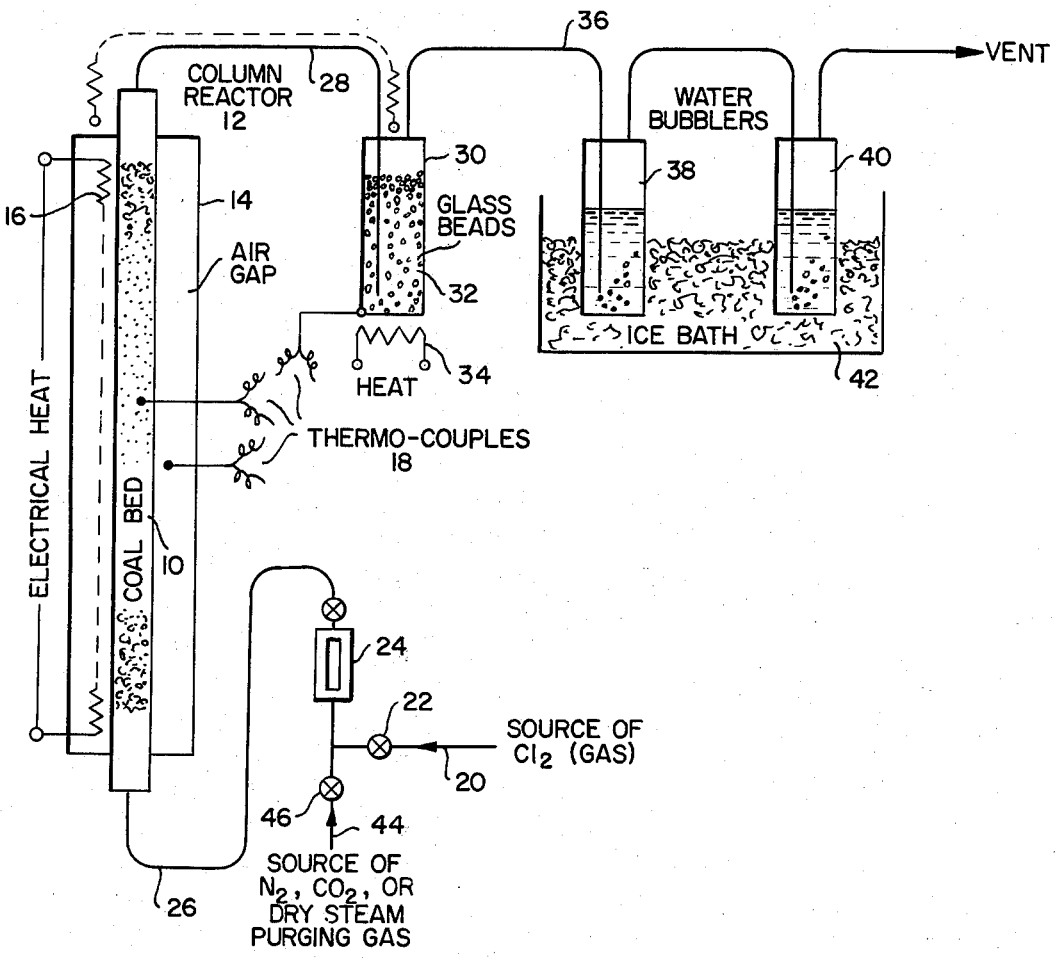
FIG. 1 illustrates a small batch-type apparatus used to perform the inventive process in batches up to 600 grams of coal per run.

In general terms, the process comprises two steps. The first step is to treat the dry coal particles with dry chlorine ($Cl_2$) gas for a period of time sufficient for the $Cl_2$ gas to react with and to remove a significant amount of the pyritic sulfur component in the coal particles. The coal particles may be at a temperature between 200°–700° F. (93°–371° C.) and preferably at about 450° F. (232° C.) because many types of coal start to devolatilize above 450° F. The $Cl_2$ gas may be at any operative pressure, preferably at atmospheric pressure or at a slightly higher pressure which is sufficient to fluidize the coal particles. Higher pressures may be used, if desired, but are not necessary. The amount of $Cl_2$ gas used is a function of the amount of sulfur in the coal and is an excess of the theoretical stoichiometric amount needed.

The $Cl_2$ gas reacts with the pyrites (mainly iron disulfide ($FeS_2$) (pyrite)) in the coal to produce impure iron chlorides, for example, ferric chloride ($FeCl_3$), and impure sulfur chlorides, for example, sulfur monochloride ($S_2Cl_2$). The impure chlorides vaporize at the operating temperatures employed whereby a significant quantity of the pyritic sulfur component is removed from the coal in the first step.

The $Cl_2$ gas also reacts with or transforms, by some mechanism, the organic sulfur component and the sulfate sulfur component present in the coal. However, the first step alone is not effective in removing a significant quantity of organic sulfur from the coal. The second step, described below, is required in order to remove significant amounts of organic sulfur.

The second step is to treat the chlorinated coal particles (from the first step) with a purging gas, for example, dry (superheated) steam or an inert gas, such as nitrogen or carbon dioxide, for a period of time sufficient for the purging gas to remove a significant amount of the organic sulfur component in the coal particles. The purging gas may be at a temperature of 450°–700° F. (232°–371° C.) and preferably at about 500° F. (260° C.). Higher temperatures are not used because the coal will degrade.

The purging gas may be at any operative pressure, preferably at atmospheric pressure or at a slightly higher pressure which is sufficient to fluidize the coal particles. The amount of purging gas used is a function of the amount of organic sulfur in the coal and is an excess of the theoretical amount needed to remove the organic sulfur component in the coal. The purging gas also strips off and carries away any residual $Cl_2$ gas and any residual chloride vapors from the first step.

As mentioned previously, the combination of the two steps in the process is critical to the removal of organic sulfur. Furthermore, the second step alone (i.e., without the first step) is not effective in removing a significant amount of sulfur of any form.

The effluent vapors may be selectively condensed by virtue of temperature differences. The $Cl_2$ gas may be regenerated separately from the $S_2Cl_2$ and $FeCl_3$ by known methods. Useful by-products are sulfur and iron oxide.

Referring to FIG. 1, the drawing illustrates a small batch-type apparatus used to perform the process. Coal bed 10 (composed of dry coal particles) is placed in column reactor 12 which is surrounded by an air gap inside outer casing 14 and which is heated by electrical heat source 16. The coal bed consists of particles which are relatively small in size, preferably in the size range of $\frac{1}{4}'' \times 0$, that is, $\frac{1}{4}''$ in diameter down to the smallest possible particle (powder). Most preferred are particles in the size range of 10 mesh × 100 mesh, that is, particles which will pass through 10 mesh, but will not pass through 100 mesh. Smaller particles become difficult to handle.

The temperature of coal bed 10 is monitored by thermocouples 18 and is maintained at a constant temperature in the range of 200°–500° F. (93°–260° C.) at atmospheric pressure. The preferred operating temperature is 450° F.(232° C.).

Dry chlorine gas 20 from any convenient source (for example, a commercially available cylinder tank) is supplied to column reactor 12 through control valve 22, flow meter 24, and feed line 26. The flow of chlorine gas is upward through coal bed 10. The amount of chlorine used is a stoichiometric excess of the amount theoretically needed to react with all of the sulfur in the coal particles, preferably about 4–7 standard cubic feet per hour of dry chlorine gas per pound of coal particles being treated at atmospheric pressure. Chlorine is toxic and expensive; thus, the minimum amount possible to give a simple excess is most preferred.

The chlorine reacts with the pyritic sulfur in the coal, producing impure iron chlorides and sulfur chlorides which vaporize at the operating temperatures in reactor 12. The $Cl_2$ gas also reacts with, or changes in some way, the organic sulfur and sulfate sulfur in the coal particles.

The unreacted chlorine gas, the iron chlorides, and the sulfur chlorides flow out through exit line 28 to condenser 30 containing glass beads 32. Electrical heat source 34 maintains the glass beads at a temperature low enough to preferentially condense iron chlorides (for example, about 250°–300° F. (121°–149° C.)).

The effluent then passes through effluent line 36 to water bubbler condensers 38 and 40 in ice bath 42 where sulfur and sulfur chlorides are condensed.

A typical run of $Cl_2$ gas is for about one hour duration. The treatment time may be shortened for smaller coal particle sizes or higher pressures of $Cl_2$ gas. After the chlorine gas has completely reacted with the sulfur in the coal particles, control valve 22 is closed.

Purging gas 44 from any convenient source (for example, dry steam from a boiler, nitrogen from a cylinder tank, or carbon dioxide from a cylinder tank) is then supplied to coal bed 10 through control valve 46, flow meter 24, and feed line 26. The purging gas flows upwardly through coal bed 10 and strips off and carries away through effluent line 28 the organic sulfur, any residual chlorine gas, and any residual chlorine vapors. When dry steam is used as the purging gas, it has an unexpected beneficial effect in loosening and removing additional increments of organic sulfur from the coal particles.

Purging gas 44 is preferably at 450°–500° F. (232°–260° C.). The preferred amount of purging gas is about 8–14 standard cubic feet per hour of purging gas per pound of coal being treated at atmospheric pressure. Larger amounts may be employed, but are not necessary. A typical run of purging gas is for about one hour duration. The treatment time may be shortened for smaller coal particle sizes or higher purging gas pressures.

Examples which illustrate the principles of the inventive process are presented in Examples 1–9. The effect of temperature on the desulfurization of Illinois #6 coal is illustrated in Examples 1 through 3 whereas in Examples 4 through 6, the temperature is fixed and the relative performance of Illinois, Pittsburgh, and Washington coals is shown. Examples 7 through 9 show the effect of different purging gas conditions on the desulfurization process.

EXAMPLE 1

Bituminous coal from the Norris Mine (Central Illinois Power & Light Co.) was treated under the following two-step operating conditions in an apparatus of the type illustrated in FIG. 1:

| | | |
|---|---|---|
| (a) Chlorination: | Bed temperature: | 200° F. (93° C.) |
| | Chlorine rate: | 1 SCFH (Standard |

-continued

| | | |
|---|---|---|
| | | $ft^3$ per hour) |
| | Amt. Coal Sample: | 0.20 lb |
| | Test duration: | 1 hour |
| | Coal size: | Through 10 mesh, on 80 mesh |
| (b) Purging: | Temperature: | 500° F. (260° C.) |
| | Steam/gas rate: | Dry steam - 2 SCFH |
| | Test duration: | 1 hour |

-continued

| | | |
|---|---|---|
| (b) Purging: | Temperature: | 500° F. (260° C.) |
| | Steam/gas rate: | Dry steam - 2 SCFH |
| | Test duration: | 1 hour |

The results of two runs under the above operating conditions are summarized in Table 2 below:

TABLE 2

LABORATORY ANALYSIS

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| Central Illinois Power & Light - Norris Mine Bituminous Coal | 0.64 | 0.50 | 2.28 | 0.05 | 0.75 | 1.50 | Pyr = 92.2<br>Sulf = −50.0*<br>Org = 34.2<br>Total = 33.9 | No Change | | Negligible | |
| | TOTAL S = 3.42% | | | TOTAL S = 2.26% | | | | | | | |
| Same coal as above repeat run | 0.64 | 0.50 | 2.28 | 0.04 | 0.85 | 1.65 | Pyr = 93.8<br>Sulf = −70.0*<br>Org = 27.6<br>Total = 25.7 | No Change | | Negligible | |
| | TOTAL S = 3.42% | | | TOTAL S = 2.54% | | | | | | | |

S = Sulfur
Pyr = Pyritic Sulfur
Sulf = Sulfate Sulfur
Org = Organic Sulfur
*Type of sulfur increased after test.

The results of two runs under the above operating conditions are summarized in Table 1 below (% sulfur = % sulfur by weight in all tests):

TABLE 1

LABORATORY ANALYSIS

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| Central Illinois Power & Light - Norris Mine Bituminous Coal | 0.64 | 0.50 | 2.28 | 0.45 | 0.51 | 2.11 | Pyr = 29.7<br>Sulf = −2.0*<br>Org = 7.5<br>Total = 10.2 | No Change | | Negligible | |
| | TOTAL S = 3.42% | | | TOTAL S = 3.07% | | | | | | | |
| Same coal as above repeat run | 0.64 | 0.50 | 3.5 | 0.51 | 0.48 | 3.5 | Pyr = 20.3<br>Sulf = 3.5<br>Org = 3.5<br>Total = 6.7 | No Change | | Negligible | |
| | TOTAL S = 3.42% | | | TOTAL S = 3.19% | | | | | | | |

S = Sulfur
Pyr = Pyritic Sulfur
Sulf = Sulfate Sulfur
Org = Organic Sulfur
*Type of sulfur increased after test.

EXAMPLE 2

Bituminous coal from the Norris Mine was treated again under the following two-step operating conditions in an apparatus corresponding to FIG. 1:

| | | |
|---|---|---|
| (a) Chlorination: | Bed temperature: | 300° F. (149° C.) |
| | Chlorine rate: | 1 SCFH |
| | Amt. Coal sample: | 0.18 lb |
| | Test duration: | 1 hour |
| | Coal size: | Through 10 mesh, on 80 mesh |
| (b) Purging: | Temperature: | 500° F. (260° C.) |
| | Steam/gas rate: | Dry steam - 2 SCFH |
| | Test duration: | 1 hour |

EXAMPLE 3

Bituminous coal from the Norris Mine was treated again under the following two-step operating conditions:

| | | |
|---|---|---|
| (a) Chlorination: | Bed temperature: | 450° F. (232° C.) |
| | Chlorine rate: | 1 SCFH |
| | Amt. coal sample: | 0.15 lb |
| | Test duration: | 1 hour |
| | Coal size: | Through 10 mesh, on 80 mesh |
| (b) Purging: | Temperature: | 500° F. (260° C.) |
| | Steam/gas rate: | Dry steam - 2 SCFH |
| | Test duration: | 1 hour |

The results of two runs under the above operating conditions are shown in Table 3 below:

TABLE 3

LABORATORY ANALYSIS

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| Central Illinois Power & Light - Norris Mine Bituminous Coal | 0.64 | 0.50 | 2.28 | 0.01 | 0.45 | 1.35 | Pyr = 98.4<br>Sulf = 10.0<br>Org = 40.8<br>Total = 47.4 | No Change | | Negligible | |
| | TOTAL S = 3.42% | | | TOTAL S = 2.26% | | | | | | | |
| Same coal as above repeat run | 0.64 | 0.50 | 2.28 | 0.02 | 0.42 | 1.31 | Pyr = 96.9<br>Sulf = 16.0<br>Org = 42.5<br>Total = 48.8 | No Change | | Negligible | |
| | TOTAL S = 3.42% | | | TOTAL S = 1.75% | | | | | | | |

S = Sulfur
Pyr = Pyritic Sulfur
Sulf = Sulfate Sulfur
Org = Organic Sulfur

EXAMPLE 4

Bituminous coal from Pittsburgh, Pennsylvania (Bureau of Mines) was treated under the following two-step operating conditions:

| | | |
|---|---|---|
| (a) Chlorination: | Bed temperature: | 350° F. (177° C.) |
| | Chlorine rate: | 1 SCFH |
| | Amt. coal sample: | 0.16 lb |
| | Test duration: | 1 hour |
| | Coal size: | Through 10 mesh, on 80 mesh |
| (b) Purging: | Temperature: | 500° (260° C.) |
| | Steam/gas rate: | Dry steam - 2 SCFH |
| | Test duration: | 1 hour |

The results of two runs under the foregoing operating conditions are shown in Table 4 below:

EXAMPLE 5

Bituminous coal from the Norris Mine (Central Illinois Power & Light Co.) was treated again under the following two-step operating conditions:

| | | |
|---|---|---|
| (a) Chlorination: | Bed temperature: | 450° F. (232° C.) |
| | Chlorine rate: | 1 SCFH |
| | Amt. coal sample: | 0.18 lb |
| | Test duration: | 1 hour |
| | Coal size: | Through 16 mesh, on 100 mesh |
| (b) Purging: | Temperature: | 500° F. (260° C.) |
| | Steam/gas rate: | Dry steam - 2 SCFH |
| | Test duration: | 1 hour |

The results of two runs under the above operating conditions are summarized in Table 5 below:

TABLE 4

LABORATORY ANALYSIS

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| Bureau of Mines - Pittsburgh, Pa. | 2.98 | 0.16 | 0.03 | 0.11 | 0.02 | 0.04 | Pyr = 96.3<br>Sulf = 87.5<br>Org = −33.3*<br>Total = 94.6 | No Change | | Negligible | |
| Sommerset, Middle Kittaning | | | | | | | | | | | |
| | TOTAL S = 3.17% | | | TOTAL S = 0.17% | | | | | | | |
| Same coal as above - repeat run | 2.98 | 0.16 | 0.03 | 0.15 | 0.01 | 0.05 | Pyr = 95<br>Sulf = 93.8<br>Org = −66.6*<br>Total = 93.4 | No Change | | Negligible | |
| | TOTAL S = 3.17% | | | TOTAL S = 0.21% | | | | | | | |

S = Sulfur
Pyr = Pyritic Sulfur
Sulf = Sulfate Sulfur
Org = Organic Sulfur
*Type of sulfur increased after test.

TABLE 5

LABORATORY ANALYSIS

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| Central Illinois Power & Light - Norris Mine | 0.64 | 0.50 | 2.28 | 0.03 | 0.51 | 1.18 | Pyr = 95.3<br>Sulf = −2*<br>Org = 48.3<br>Total = 48.0 | No Change | | Negligible | |
| Bituminous Coal | TOTAL S = 3.42% | | | TOTAL S = 1.78% | | | | | | | |
| Same coal as above - repeat run | 0.64 | 0.50 | 2.28 | 0.02 | 0.48 | 1.21 | Pyr = 96.9<br>Sulf = 46<br>Org = 46.9 | No Change | | Negligible | |

TABLE 5-continued

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| | TOTAL S = 3.42% | | | TOTAL S = 1.71% | | | Total = 50.0 | | | | |

S = Sulfur
Pyr = Pyritic Sulfur
Sulf = Sulfate Sulfur
Org = Organic Sulfur
*Type of sulfur increased after test.

EXAMPLE 6

Sub-bituminous coal from the State of Washington was treated under the following two-step operating conditions:

| | | |
|---|---|---|
| (a) Chlorination: | Bed temperature: | 450° F. (232° C.) |
| | Chlorine rate: | 1 SCFH |
| | Amt. coal sample: | 0.20 |
| | Test duration: | 1 hour |
| | Coal size: | Through 10 mesh, on 80 mesh |
| (b) Purging: | Temperature: | 500° F. (260° C.) |
| | Steam/gas rate: | Dry steam - 2 SCFH |
| | Test duration: | 1 hour |

The results of two runs under the above operating conditions are shown in Table 6 below:

TABLE 6

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| Washington State Sub-Bituminous Mines Unknown | 0.87 | 0.04 | 0.75 | 0.05 | 0.01 | 0.48 | Pyr = 94.3 | No Change | | Negligible | |
| | | | | | | | Sulf = 75.0 | | | | |
| | | | | | | | Org = 36.0 | | | | |
| | TOTAL S = 1.66% | | | TOTAL S = 0.54% | | | Total = 67.5 | | | | |
| Same as above - repeat run | 0.87 | 0.04 | 0.75 | 0.06 | 0.03 | 0.49 | Pyr = 93.1 | No Change | | Negligible | |
| | | | | | | | Sulf = 25 | | | | |
| | | | | | | | Org = 34.7 | | | | |
| | TOTAL S = 1.66% | | | TOTAL S = 0.58% | | | Total = 65.1 | | | | |

S = Sulfur
Pyr = Pyritic Sulfur
Sulf = Sulfate Sulfur
Org = Organic Sulfur

EXAMPLE 7

Lignite coal from the Noonan Mine (North Dakota) was treated under the following two-step operating conditions in an apparatus of the type illustrated in FIG. 1:

| | | |
|---|---|---|
| (a) Chlorination: | Bed temperature: | 450° F. (232° C.) |
| | Chlorine rate: | 1 SCFH |
| | Amt. coal sample: | 0.21 |
| | Test duration: | 1 hour |
| | Coal size: | Through 10 mesh, on 80 mesh |
| (b) Purging: | Temperature: | 500° F. (260° C.) |
| | Steam/gas rate: | Dry steam - 2 SCFH |
| | Test duration: | 1 hour |

The results of two runs under the foregoing operating conditions are summarized in Table 7 below:

TABLE 7

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| North Dakota lignite - Noonan Mine | 0.18 | 0.04 | 0.50 | 0.02 | 0.05 | 0.36 | Pyr = 88.9 | No Change | | Negligible | |
| | | | | | | | Sulf = −25* | | | | |
| | | | | | | | Org = 28.0 | | | | |
| | TOTAL S = 0.72% | | | TOTAL S = 0.43% | | | Total = 40.3 | | | | |
| Same coal as above - repeat run | 0.18 | 0.04 | 0.50 | 0.01 | 0.09 | 0.40 | Pyr = 94.5 | No Change | | Negligible | |
| | | | | | | | Sulf = −125* | | | | |
| | | | | | | | Org = 20.0 | | | | |
| | TOTAL S = 0.72% | | | TOTAL S = 0.50% | | | Total = 30.6 | | | | |

S = Sulfur
Pyr = Pyritic Sulfur
Sulf = Sulfate Sulfur
Org = Organic Sulfur
*Type of sulfur increased after test.

EXAMPLE 8 (NITROGEN PURGING)

Bituminous coal from the Norris Mine was again treated under the following two-step operating conditions:

| | | |
|---|---|---|
| (a) Chlorination: | Bed temperature: | 450° F. (232° C.) |
| | Chlorine rate: | 1 SCFH |
| | Amt. coal sample: | 0.18 lb |
| | Test duration: | 1 hour |
| | Coal Size: | Through 10 mesh, on 80 mesh |
| (b) Purging: | Temperature: | 500° F. (260° C.) |
| | Steam/gas rate: | $N_2$ gas - 2 SCFH |
| | Test duration: | 1 hour |

The results of two runs under the foregoing operating conditions are summarized in Table 8 below:

TABLE 8

LABORATORY ANALYSIS

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| Central Illinois Power & Light - Norris Mine Bituminous Coal | 0.64 | 0.50 | 2.28 | 0.03 | 0.78 | 1.47 | Pyr = 95.31<br>Sulf = −56.0*<br>Org = 35.5<br>Total = 33.34 | No Change | | Negligible | |
| | TOTAL S = 3.42% | | | TOTAL S = 2.28% | | | | | | | |
| Same coal as above - repeat run | 0.64 | 0.50 | 2.28 | 0.04 | 0.82 | 1.68 | Pyr = 93.8<br>Sulf = −64.0*<br>Org = 26.3<br>Total = 25.73 | No Change | | Negligible | |
| | TOTAL S = 3.42% | | | TOTAL S = 2.54% | | | | | | | |

S = Sulfur
Pyr = Pyritic Sulfur
Sulf = Sulfate Sulfur
Org = Organic Sulfur
*Type of sulfur increased after test.

EXAMPLE 9 (Carbon Dioxide Purging)

Bituminous coal from the Norris Mine was again treated under the following two-step operating conditions:

| | | |
|---|---|---|
| (a) Chlorination: | Bed temperature: | 450° F. (232° C.) |
| | Chlorine rate: | 1 SCFH |
| | Amt. coal sample: | 0.18 lb |
| | Test duration: | 1 hour |
| | Coal size: | Through 10 mesh, on 80 mesh |
| (b) Purging: | Temperature: | 500° F. (260° C.) |
| | Steam/gas rate: | $CO_2$ gas - 2 SCFH |
| | Test duration: | 1 hour |

The results of two runs under the above operating conditions are shown in Table 9 below:

TABLE 9

LABORATORY ANALYSIS

| Coal Sample ID (Rank, County, State) | % Sulfur-Before Test Pyritic | Sulfate | Organic | % Sulfur-After Test Pyritic | Sulfate | Organic | Sulfur Removal Efficiency (%) | (%) Chloride/Chlorine Before Test | After Test | Btu Loss | Wt. Loss |
|---|---|---|---|---|---|---|---|---|---|---|---|
| Central Illinois Power & Light - Norris Mine Bituminous Coal | 0.64 | 0.50 | 2.28 | 0.01 | 0.75 | 1.50 | Pyr = 98.43<br>Sulf = −50.0*<br>Org = 34.2<br>Total = 33.9 | No Change | | Negligible | |
| | TOTAL S = 3.42% | | | TOTAL S = 2.26% | | | | | | | |
| Same coal as above - repeat run | 0.64 | 0.50 | 2.28 | 0.03 | 0.85 | 1.65 | Pyr = 95.3<br>Sulf = −70.0*<br>Org = 27.6<br>Total = 26.0 | No Change | | Negligible | |
| | TOTAL S = 3.42% | | | TOTAL S = 2.53% | | | | | | | |

S = Sulfur
Pyr = Pyritic Sulfur
Sulf = Sulfate Sulfur
Org = Organic Sulfur
*Type of sulfur increased after test.

As can be seen from Examples 1 through 3, temperature has a pronounced effect on sulfur removal. As the temperature was increased from 200° F. to 450° F., the sulfur removal efficiency increased steadily. 450° F. (232° C.) is believed to be an optimum, as beyond it, most coals start to devolatilize. The higher temperatures affect mostly organic sulfur removal by severing the carbon-sulfur bonds in the coal. For ease of reference, the average values of sulfur removal for the different temperatures used in Examples 1-3 are tabulated in Table 10 below:

TABLE 10

| Operating Temperature (°F.) | Sulfur Removal Efficiency (Average %) Pyritic | Organic | Sulfate | Total |
|---|---|---|---|---|
| 200 (93° C.) | 25.0 | 5.5 | 0.7 | 8.5 |
| 300 (149° C.) | 93.0 | 30.9 | 60.0 | 29.8 |
| 450 (232° C.) | 97.6 | 41.7 | 13.0 | 48.1 |

Caking coals degrade at a lower temperature than 450° F. (232° C.). One of these, an eastern bituminous high-pyritic coal (Example 4), was tested at 350° F. (177° C.) instead of at 450° F. Since the coal contained mostly pyritic-type sulfur, the process was successful in removing most of the sulfur, even at the lower temperature.

A comparison of Examples 4 and 5 indicates that the smaller coal particles respond better to $Cl_2$ treatment. However, there is a practical limitation in generating and handling finer particles. Organic sulfur is significantly more affected when finer particles of the coal are treated with chlorine. The coal from the Norris Mine, Ill., when subjected to this process, gave the following results:

TABLE 11

| Particle Size | Sulfur Removal Efficiency (Average %) | | | |
|---|---|---|---|---|
| | Pyritic | Organic | Sulfate | Total |
| Through 10 mesh, on 80 mesh | 97.5 | 41.7 | 1.5 | 48.1 |
| Through 16 mesh, on 100 mesh | 96.1 | 47.6 | no change | 49.0 |

The results presented in Examples 3, 8, and 9 reveal that dry steam is best for stripping the coal after chlorination, as it removes additional sulfur, particularly organic sulfur.

TABLE 12

| Purging Gas | Sulfur Removal Efficiency (Average %) | | | |
|---|---|---|---|---|
| | Pyritic | Organic | Sulfate | Total |
| Dry steam | 97.5 | 41.7 | 1.5 | 48.1 |
| $N_2$ | 94.6 | 30.9 | 60.0 | 28.5 |
| $CO_2$ | 96.9 | 30.9 | 60.0 | 30.0 |

As noted before, an eastern bituminous high-pyritic coal (Example 4) had the greatest overall sulfur removal efficiency, even at lower temperatures. The average values of sulfur removed for the different coals used in Examples 3, 4, 6 and 7 are tabulated in Table 13 below:

TABLE 13

| Coal Rank | Sulfur Removal Efficiency (Average %) | | | |
|---|---|---|---|---|
| | Pyritic | Organic | Sulfate | Total |
| Midwestern Bituminous (Illinois #6) | 97.5 | 41.75 | 1.5 | 48.1 |
| Eastern Bituminous (Pittsburgh) (Run at lower temp.) | 95.7 | no change | 90.7 | 94.5 |
| Sub-Bituminous (Washington State) | 93.7 | 35.4 | 62.5 | 66.7 |
| Lignite (North Dakota) | 91.7 | 24.0 | no change | 35.5 |

Figure 2:
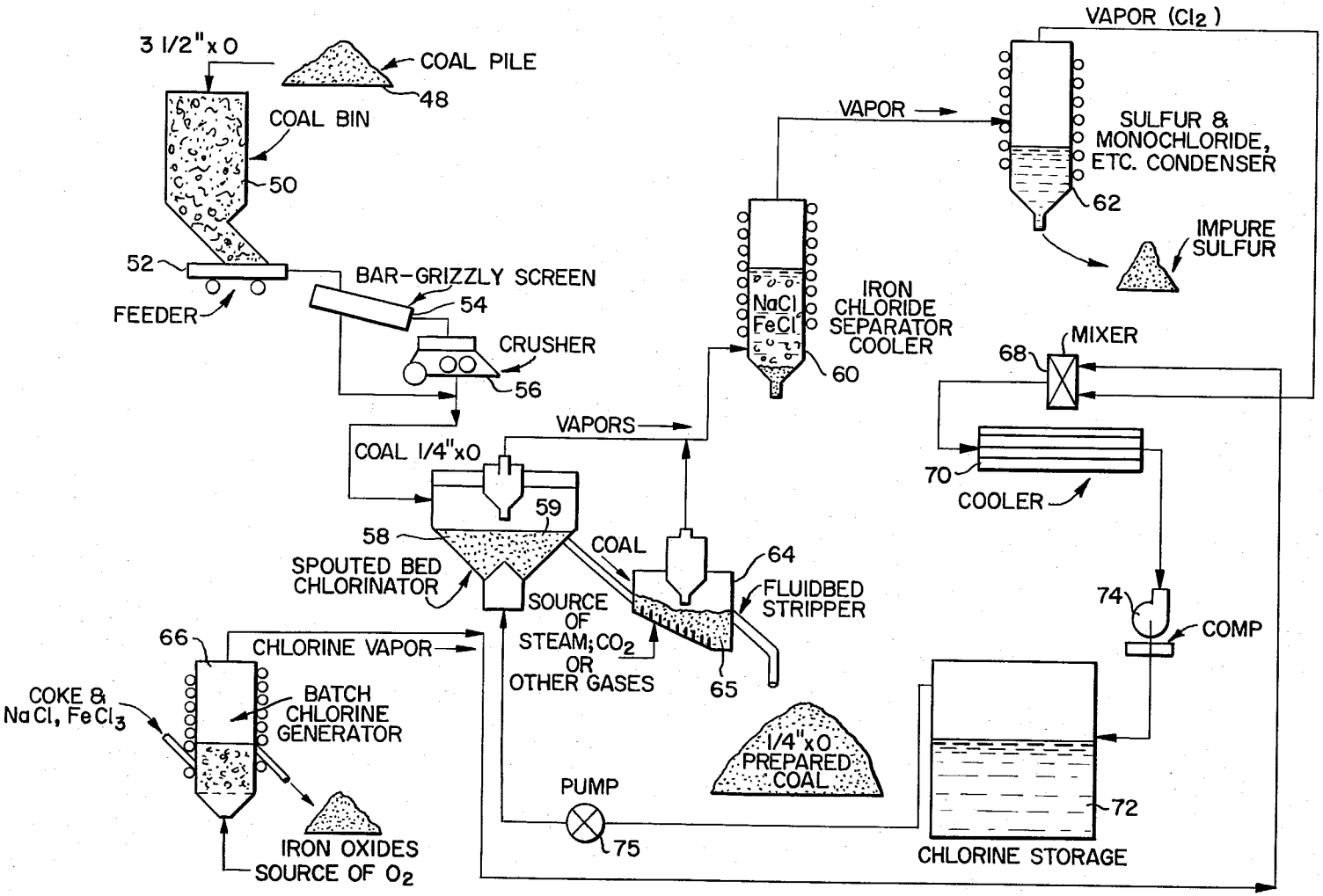
FIG. 2 is a flow chart illustrating a continuous-operation coal desulfurization system or plant embodying the principles of the invention.

Referring to FIG. 2, the drawing is a flow chart which illustrates a continuous operation coal desulfurization system or plant. Coal pile 48 is run-of-mine dry coal having a size range of $3\frac{1}{2}''\times 0$. The coal is stored in coal bin 50 from which it is transferred by feeder 52 to Bar-Grizzly screen 54 and then to secondary crusher 56. Crusher 56 sizes the feed coal in the size range of $\frac{1}{4}''\times 0$ for chlorinator reactor 58.

The coal particle size depends on the manner in which the pyritic sulfur occurs in the coal. With respect to organic sulfur, particle size does not make any difference directly, but the coal particle size may indirectly affect desulfurization rates.

Chlorinator 58, preferably a spouted bed chlorinator, operates at a temperature level of about 470°-700° F. (232°-371° C.) with excess chlorine gas. Coal of $\frac{1}{4}''\times 0$ size is continuously fed into chlorinator 58 where coal bed 59 is maintained, preferably in a fluidized state.

A spouted bed chlorinator has the structure and mode of operation of the apparatus shown in my copending U.S. patent application Ser. No. 183,781 filed Sept. 3, 1980 entitled "Apparatus For Mixing And Distributing Solid Particulate Material," and the disclosure of that application is incorporated by reference herein.

Vapors from chlorinator 58 pass to iron chloride separator-cooler 60 where iron chlorides are condensed and removed. Vapors from separator-cooler 60 then pass to sulfur and monochloride condenser 62 where sulfur, sulfur monochloride, and other gases (except chlorine) are condensed and removed.

Coal from chlorinator 58 is transferred continuously to stripper 64 where a purging gas (for example, dry steam or an inert gas, such as carbon dioxide or nitrogen) at a temperature level of about 450°-700° F. (232°-371° C.) is blown upwardly through coal bed 65 to eliminate organic sulfur. Preferably, stripper 64 is a fluid bed stripper wherein coal bed 65 is maintained in a fluidized state.

Iron chloride separator-cooler 60 operates at a constant temperature of about 250° F. (121° C.) The unit contains some sodium chloride (NaCl) to capture ferrous chloride vapor as an impurity which has a higher condensing temperature. NaCl is also needed in batch chlorine generator 66 for the generation of $Cl_2$ from ferric chloride.

Sulfur and monochloride condenser 62, where most of the sulfur monochloride and other impurities are condensed, operates at the ambient temperature or below. Free chlorine gas passes to mixer 68, then through cooler 70 to remove any moisture. From time to time, sulfur and other impurities have to be cleaned out of condenser 62.

Mixer 68 may be a simple tee connection. It receives chlorine from both condenser 62 and batch chlorine generator 66.

The dry chlorine from cooler 70 is stored in chlorine storage tank 72 after passing through compressor 74. The chlorine is fed by pump 75 to spouted bed chlorinator 58 from storage tank 72.

The removal of organic sulfur, residual $Cl_2$ gas, residual iron chlorides, and sulfur from the surface of the coal particles in coal bed 65 (inside stripper 64) is accomplished by means of the purging gas previously discussed. The chlorinator and stripper may be combined to operate in a single unit (for example, as in FIG. 1). From stripper 64, the prepared coal is then transferred to a storage receptacle where it is ready for gasification or combustion processing.

From time to time, sodium and iron chlorides, and carbon particles with other combustibles are removed from iron chloride separator-cooler 60 and transferred to batch chlorine generator 66. Extra coke and oxygen are needed to generate chlorine and iron oxide. This batch generator is operated intermittently and also produces iron oxide, a useful product from the wastes.

The above-described embodiments are intended to be illustrative, not restrictive. The full scope of the invention is defined by the claims, and any and all equivalents are intended to be embraced.

I claim:

1. A process for the desulfurization and improvement of combustion and gasification characteristics of dry coal particles containing sulfur in pyritic, organic, and sulfate forms, said process comprising the steps of:

(a) treating said dry coal particles with an effective amount of dry chlorine gas at a temperature and for a period of time which are sufficient for the chlorine gas to react with the sulfur in the coal particles whereby a significant quantity of pyritic sulfur is removed from the coal particles; and, (b) treating the coal particles with an effective amount of a purging gas at a temperature and for a period of time which are sufficient for the purging gas to remove a significant quantity of organic sulfur from the coal particles.

2. The process defined in claim 1 wherein the coal particles are in the size range of $\frac{1}{4}'' \times 0$.

3. The process defined in claim 1 wherein the coal particles are in the size range of 10 mesh × 100 mesh.

4. The process defined in claim 1 wherein the amount of chlorine gas used is a stoichiometric excess of the amount theoretically needed to react with all of the sulfur in the coal particles.

5. The process defined in claim 1 wherein about 4–7 standard cubic feet per hour of dry chlorine gas is used per pound of coal particles being treated.

6. The process defined in claim 1 wherein the dry chlorine gas is at atmospheric pressure and at a temperature of about 200°–700° F.

7. The process defined in claim 1 wherein the dry chlorine gas is at a temperature of about 450° F.

8. The process defined in claim 1 wherein the coal particles are treated with dry chlorine gas for a period of about one hour.

9. The process defined in claim 1 wherein the purging gas is selected from the group consisting of dry steam, nitrogen, and carbon dioxide.

10. The process defined in claim 1 wherein the purging gas is dry steam.

11. The process defined in claim 1 wherein about 8–14 standard cubic feed per hour of the purging gas is used per pound of coal particles being treated.

12. The process defined in claim 1 wherein the purging gas is at atmospheric pressure and at a temperature of about 450°–700° F.

13. The process defined in claim 1 wherein the purging gas is at a temperature of about 500° F.

14. Apparatus for the desulfurization and improvement of combustion and gasification characteristics of dry coal particles containing sulfur in pyritic, organic, and sulfate forms, said apparatus comprising:

(a) a means for providing dry chlorine gas;

(b) a chlorinator means for treating said dry coal particles with an excess amount of dry chlorine gas at a temperature and for a period of time which are sufficient for the chlorine gas to react with the sulfur in the coal particles whereby a significant quantity of pyritic sulfur is removed from said coal particles;

(c) a means for providing a purging gas; and, (d) a stripper means for treating said coal particles with a purging gas at a temperature and for a period of time which are sufficient for the purging gas to remove a significant quantity of organic sulfur from said coal particles.

15. The apparatus defined in claim 14 wherein the chlorinator means and the stripper means are combined in a single unit.

16. The appartus defined in claim 14 wherein the chlorinator means is a spouted bed chlorinator.

17. The apparatus defined in claim 14 wherein the stripper means is a fluid bed stripper.

18. A system for the desulfurization and improvement of combustion and gasification characteristics of dry coal particles containing sulfur in pyritic, organic, and sulfate forms, said system comprising:

(a) a coal storage means for storing said dry coal particles;

(b) a coal feeder means for feeding said coal particles from said coal storage means;

(c) a coal crusher means for crushing and reducing the size of said coal particles received from said coal feeder means;

(d) a means for providing dry chlorine gas;

(e) a chlorinator means for treating said coal particles with an excess amount of dry chlorine gas whereby a significant quantity of pyritic sulfur is removed from said coal particles;

(f) a means for providing a purging gas;

(g) a stripper means for treating said coal particles from said chlorinator means with a purging gas whereby a significant quantity of organic sulfur is removed from said coal particles;

(h) an iron chloride separator means for removing iron chlorides from vapors received from said chlorinator means and from said stripper means; and, (i) a sulfur and monochloride condenser means for removing sulfur and sulfur monochloride from vapors received from said iron chloride separator means.

19. The apparatus defined in claim 18 wherein the chlorinator means is a spouted bed chlorinator.

20. The apparatus defined in claim 18 wherein the stripper means is a fluid bed stripper.

* * * * *